United States Patent [19]

Hellwig

[11] Patent Number: 4,645,704

[45] Date of Patent: Feb. 24, 1987

[54] REFLECTING TEXTILE WEB AND METHOD FOR THE PRODUCTION THEREOF

[75] Inventor: Manfred Hellwig, Öhringen, Fed. Rep. of Germany

[73] Assignee: Konrad Hornschuch AG, Weissbach, Fed. Rep. of Germany

[21] Appl. No.: 778,907

[22] Filed: Sep. 23, 1985

[30] Foreign Application Priority Data

Mar. 8, 1985 [EP] European Pat. Off. ..... 85102648

[51] Int. Cl.[4] ..... B32B 1/00

[52] U.S. Cl. ..... 428/176; 427/270; 427/288; 428/209; 428/242; 428/246; 428/252; 428/253; 428/285; 428/286; 428/912.2

[58] Field of Search ..... 428/209, 176, 242, 246, 428/252, 253, 285, 286, 912.2; 427/256, 288, 270

[56] References Cited

U.S. PATENT DOCUMENTS 4,477,312 10/1984 Czichy ..... 428/270

*Primary Examiner*—Marion C. McCamish
*Attorney, Agent, or Firm*—Frost & Jacobs

[57] ABSTRACT

A reflecting flexible textile web is proposed comprising a textile support metal coated on at least one side and in the form of a woven fabric, knitted fabric, non-woven fabric or thread ply sewn fabric, the threads or fibres of which are coated with possibly flame-retarding modified transparent plastic, in which high reflectivity is achieved for infrared radiation but at the same time translucence or light in the visible region in that the metal coating takes place substantially only in the region of the intersections of the threads or fibres while the regions of the textile support disposed between the intersections are substantially free from metal coating and thus permeable to light. Furthermore, a method for making said textile web is proposed in which the textile support is firstly coated by immersion impregnation with a highly viscous plastic dispersion and metal is transferred in the transfer method from a metal-coated foil under elevated temperature and elevated temperature selectively to the raised regions of the plastic-coated textile support. The textile web can be used in particular for making sun roller blinds and insulating roller blinds.

20 Claims, No Drawings

REFLECTING TEXTILE WEB AND METHOD FOR THE PRODUCTION THEREOF

FIELD OF THE INVENTION

The invention relates to a reflecting flexible textile web of a textile support metal coated on at least one side and in the form of a woven fabric, knitted fabric, non-woven fabric or thread ply sewn fabric, whose threads or fibres are coated with possibly flame-retarding modified transparent plastic, and to a method for the production thereof.

BACKGROUND OF THE INVENTION

German Patent Application No. 3,135,271 discloses an infrared-radiation-reflecting flexible multilayer material web in which a support mesh is adhesively bonded on both sides to a textile support web and in which the two textile support webs are each provided on the outside with a metal coating and the metal coatings are provided with a further protective coating. This known material web is distinguished by high thermal reflection with simultaneous vapour permeability. The two metal coatings in the known material web, which is apparently to be used for making insulating blinds as employed in particular for roof windows, are formed as cohesive closed metal layers vapour deposited in vacuum and are therefore completely opaque to light in the visible range, i.e. in the wavelength range between 0.365 and 0.75 μm.

European Patent Publication No. 109,638 discloses a method of making metallized textile sheet structures in which the textile properties of the support are retained in that a metal layer applied to the textile material by either an electroless, wet chemical or vapour deposition method is subsequently thickened by electroplating. The metallized textile web made in this manner has because of its high electrical and thermal conductivity a good heat stability and high reflectivity for incident electromagnetic radiation; it is therefore suitable for example for making flexible screen antennas for radar waves but can also be used in all cases where the carrying away of electrostatic charges or the screening of high-frequency electromagnetic waves is important. These metal layers deposited in electroless manner or electrolytically and thickened by electroplating are also completely impermeable to light in the visible range.

DE No. 3,016,191 discloses a non-inflammable sun protection blind comprising a textile support in the form of a woven fabric, knitted fabric, non-woven fabric or a thread ply sewn fabric whose threads or fibres are impregnated with two different layers of flexible halogen-free plastic, that is a duroplastic and a thermoplastic plastic layer, both plastic layers containing a halogen-free flame-retarding agent. This known sun protection blind is not metal coated; it is thus permeable both to light in the visible range and to radiation of longer wavelength in the near infrared range (0.75–3 μm).

Furthermore, various insulating blinds or insulating blind materials are on the market which in particular are used to keep off excessive solar radiation for roof windows and which are made by laminating a relatively thick aluminium foil to a textile material, the bonding being obtained by an adhesive layer between the metal foil and the textile material. These relatively stiff insulating blinds are also completely impermeable to light in the visible range. It is an object of this invention to provide a metal-coated flexible textile web which has a high reflectivity for infrared radiation in the near IR range between about 0.75 and 3 μm but at the same time has good transmission and translucence properties for light in the visible range between 0.365 and 0.75 μm and in spite of the metal coating on at least one side retains its textile appearance and its textile nature. A further object of the invention is to provide a method for producing such a textile web.

Thus, this invention provides a textile web of the type mentioned at the beginning in that the metal coating is disposed substantially only in the region of the intersections of the threads or fibres of the textile support whilst the regions of the textile support disposed between the intersections are substantially free from the metal coating and thus permeable to light.

DESCRIPTION OF THE PREFERRED EMBODIMENTS

It has surprisingly been found that the reflectivity for infrared radiation in the wavelength region between 0.75 and 3 μm with the textile web according to the invention in which only the raised regions of the textile support are coated with the reflecting metal is only insignificantly less than the reflectivity for the same wavelength range of a textile web coated over its entire surface with metal. The term "raised regions" means in a fabric the intersection points between warp and weft threads which lie outside the plane of the warped threads and outside the plane of the weft threads; in a mesh fabric (knitted fabric, hosiery) the raised regions are those at which the stitch elements of adjacent stitch rows and stitch wales intersect, whereas in the case of tangled fibre non-woven fabrics and thread ply sewn fabrics they are the regions at which more threads or fibres intersect than intersect on an average at the thinner areas of these non-woven fabrics. Although the reflectivity of the textile web according to the invention is only slightly less in the wavelength of the near infrared range decisive for thermal protection purposes than with textile webs metal coated over the entire area, the reflecting textile web according to the invention has a high translucence for light in the visible range. A sun blind made from the textile web according to the invention thus does not lead to complete darkening of the room equipped therewith but like a textile curtain or curtain netting allows adequate light to pass in the visible range and this leads to a pleasant weakening of the sunlight but not to complete darkening. On the other hand, the incident thermal radiation is largely reflected and hardly absorbed.

If the textile web according to the invention is provided with a metal coating only on one side the purely textile appearance of the non-metallized back of the textile support is completely retained.

An advantageous embodiment of the textile web according to the invention resides in that a bonding plastic layer is disposed at least at the metal-coated areas of the web between the plastic-coated textile support and the metal coating. This improves the bonding of the metal particles to the textile support which is particularly important when the textile web is used for making roller blinds. For on unrolling and rolling up of the blind the coating is subjected to a high mechanical stress so that in the course of time the metal particles peel off if no additional bonding plastic layer is used.

Preferably, as textile support a textured fabric is used, for example a fabric in which the weft yarn is more voluminous and heavier than the warp yarn, or a fabric which is made from crimped yarns or yarns textured in other known manner. These fabrics with relief-like surface have particularly pronounced raised and lower regions which facilitates the selective metal coating only in the raised regions of the intersections of the threads or fibres of the textile web.

In a further advantageous embodiment of the textile web according to the invention the textile support is coated with a mixture of thermoplastic and thermosetting (duroplastic) plastic, preferably of acrylate copolymers which possibly additionally contain an ethylene-vinyl acetate copolymer. It has been found that the choice of such a specific plastic mixture particularly facilitates the selective more or less punctiform metal coating.

In a further advantageous embodiment of the textile web according to the invention the metal coating is coated in a manner known per se with a thin layer of a transparent protective lacquer and thereby additionally protected from abrasion, damage and wear.

The textile web according to the invention preferably has a diffused reflection of 60–90% of the light and thermal radiation, incident on the metal-coated side, of the near infrared range with wavelengths between 0.7 and 2.5 μm.

The method of making the textile web according to the invention is characterized by the combination of the following features:

(a) a possibly non-inflammatory finished textile support in the form of a woven fabric, knitted fabric, non-woven fabric or thread ply sewn fabric is thermofixed and thereafter
(b) coated with a highly viscous dispersion of a mixture of thermoplastic and thermosetting (duroplastic) transparent plastic in a suitable solvent by immersion impregnation, whereupon
(c) excess coating composition is doctored off on both sides, whereafter the support thus coated
(d) is dried in a drying passage;
(e) the plastic-coated and dried support and a metal-vapour-coated foil or sheet are preheated simultaneously but separately from each other and thereafter
(f) brought together in such a manner that the metal-coated side of the foil contacts at least one side of the plastic-coated support, and
(g) hot pressed with the aid of laminating rolls at elevated pressure, whereafter
(h) the laminate is cooled to about room temperature and
(i) the foil is peeled off again.

Preferably, for the immersion impregnation a plastic dispersion having a viscosity of 1.5 to 3.0 Pa·s, preferably 1.8 to 2.5 Pa·s is used. The area weight of the coating composition applied by immersion impregnation is preferably 60 to 120 g/m$^2$.

It has been found particularly advantageous to use for the immersion impregnation an aqueous dispersion of 50 to 60 parts by weight of a thermoplastic acrylate copolymer, 40 to 50 parts by weight of one or more self-crosslinking duroplastic acrylate homo or copolymers and 0 to 20 parts by weight ethylene-vinyl acetate copolymer. The choice of this specific plastic mixture leads to high selectivity of the bonding of the metal particles in the region of the raised areas, i.e. the thread intersections of the textile support.

If desired, for the immersion impregnation a dispersion may be used which contains in a manner known per se additionally a flame-protection agent and/or biocides. When for example the textile web according to the invention is used in public buildings such as schools, hospitals, theatres or particularly fire-endangered premises such as hotels, restaurants, discotheques or also in motor vehicles and aircraft, not only is it convenient to use a textile support finished in non-inflammable or flame-retarding manner from the start but in addition to employ for the coating as well a plastic dispersion containing a flame-protection agent. If on the other hand the textile web according to the invention is to be used in wet rooms or for interior decorating of ships then it is convenient to add to the plastic dispersion a biocide.

For cost reasons the textile support will generally be made from the usual combustible textile fibres of natural or synthetic origin but can be produced alternatively from non-inflammable fibres, for example glass fibres, ceramic fibres, metal fibres, carbon and aramide fibres.

The doctoring off on both sides of the excess coating composition is preferably carried out by means of an air doctoring system having two offset blades but other conventional doctor blades can also be used; the important point is only that the doctoring off is carried out fundamentally from both sides of the coated textile support in order to prevent on one of the two sides the depressions lying between the raised regions of the textile material from being filled with plastic composition and thus evened.

The foil coated with vapour deposited metal is preferably a polyester foil with aluminium, gold or copper vapour deposited thereon. The polyester foil serves only as auxiliary sheet or intermediate carrier for the metal layer. To achieve special esthetic effects the metal vapour deposited onto the foil may also be lacquered in a manner known per se.

A decisive advantage of the method according to the invention resides fundamentally in that the metal is transferred from an auxiliary foil to the plastic-coated textile support using pressure and heat, i.e. it is not necessary to vapour deposit metal on the entire laminate in a high vacuum. Admittedly, the auxiliary foil obtainable as such commercially must also be vapour coated with the metal but with the far simpler structure of the polyester foil this can be done very much more easily and thus more cheaply.

Preferably, a foil is used of the type comprising between the support foil of polyester and the vapour deposited metal layer a parting agent layer because then the support foil after transfer of the metal to the plastic-coated textile web can be more easily peeled off the laminate again without the transferred metal particles being pulled off the textile web.

Further, preferably a metal transfer foil is used of the type in which the vapour deposited metal layer is additionally covered with a bonding plastic layer. For the bond between the metal particles and the plastic-coated textile web is improved by the bonding plastic layer. This bonding plastic layer consists preferably of ethylene-vinyl acetate copolymer.

The metal transfer carried out with the aid of laminating rolls from the metal-coated foil to the plastic-coated textile web is preferably done under a pressure of $4.10^5$–$6.10^5$ Pa and at a temperature of about 110°–140° C.

Particularly advantageous is the use of the textile web according to the invention for making sun blinds, camouflage nets or camouflage tarpaulins, insulating roller blinds, insulating wallpapers, working clothing and the inner linings of motor vehicles and aircraft. In addition, the textile web according to the invention may be used quite generally in the motor vehicle field, in medical technology, building, both for interior fittings and on the outside of high buildings, gardening, for example for sun blinds in greenhouses, and in all cases where it is important to keep long-wave electromagnetic radiation, in particular thermal radiation, away from people, machines, apparatus, structures or surfaces.

Whereas the reflection of the radiation in the near infrared range can reach up to 90% of the incident radiation, the transmission in this wavelength range can be 10–50% with the textile web according to the invention.

The appearance of the textile web according to the invention may be varied in almost any desirable manner by using coloured textile supports and pigmented coating compositions, the translucence of the textile web being retained in every case, although account must be taken of the fact that with dark colouring of the textile support and/or the coating composition a higher thermal absorption by the textile web itself is unavoidable. Consequently, the use of unpigmented coating compositions and undyed or at least brightly dyed textile supports is preferred.

I claim:

1. A reflecting flexible textile web comprising a textile support having metal coated on at least one side thereof, said textile support being chosen from the class consisting of a woven fabric, knitted fabric, non-woven fabric and thread ply sewn fabric, whose threads are coated with flame-retarding modified transparent plastic, characterized in that the metal coating is disposed substantially only in the region of the intersections of the threads of the textile support while the regions of the textile support disposed between the intersections are substantially free from the metal coating and thus permeable to light.

2. Textile web according to claim 1, characterized in that a bonding plastic layer is disposed at least at the metal-coated areas of the web between the plastic-coated textile support and the metal coating.

3. Textile web according to claim 1, characterized in that the textile web is a textured fabric.

4. Textile web according to claim 1, characterized in that the textile support is coated with a mixture of thermoplastic and thermosetting plastic.

5. Textile web according to claim 4, characterized in that the plastic mixture consists of acrylate copolymers.

6. Textile web according to claim 5, characterized in that the acrylate copolymers additionally contain an ethylene-vinyl acetate copolymer.

7. Textile web according to claim 1, characterized in that the metal coating is coated with a thin layer of a transparent protective lacquer.

8. Textile web according to claim 1, characterized by a diffuse reflection of 60–90% of the light and thermal radiation, incident on the metal-coated side, of the near infrared range with wavelengths between 0.7 and 2.5 μm.

9. A method of producing a reflecting flexible textile web, comprising the steps of:

(a) providing a thermofixed flame resistant finished textile support chosen from the class consisting of a woven fabric, knitted fabric, non-woven fabric and thread ply sewn fabric, and thereafter (b) coating the textile support by immersion impregnation with a highly viscous dispersion of a mixture of thermoplastic and duroplastic transparent plastic in a suitable solvent (c) doctoring off excess coating composition on both sides of said textile support, (d) drying the thus coated textile support in a drying passage;

(e) simultaneously but separately preheating the plastic-coated and dried textile support and a metal-vapor-coated foil sheet, and thereafter (f) bringing together the textile support and the foil sheet in such a manner that the metal-coated side of the foil sheet contacts at least one side of the plastic coated textile support, and (g) hot pressing the textile support and the foil sheet with laminating rolls at elevated pressure, thereafter (h) cooling the laminate to about room temperature, and (i) peeling off the portions of the foil sheet which are not adhered to the textile support.

10. Method according to claim 9, characterized in that for the immersion impregnation a plastic dispersion is used having a viscosity of 1.5 to 3.0 Pa·s, preferably 1.8 to 2.5 Pa·s.

11. Method according to claim 9, characterized in that by the immersion impregnation 60–120 g/m$^2$ coating composition is applied to the support.

12. Method according to claim 9, characterized in that for the immersion impregnation an aqueous dispersion of 50 to 60 parts by weight of a thermoplastic acrylate polymer, 40 to 50 parts by weight of one or more self-crosslinking duroplastic acrylate homo or copolymers and 0 to 20 parts by weight ethylene-vinyl acetate copolymer is used.

13. Method according to claim 9, characterized in that for the immersion impregnation a dispersion is used which additionally contains a flame-protection agent and/or biocides.

14. Method according to claim 9, characterized in that the doctoring off on both sides is carried out by means of an air doctoring system having two offset blades.

15. Method according to claim 9, characterized in that as metal-coated foil a polyester foil is used on which aluminium, gold or copper is vapour deposited.

16. Method according to claim 15, characterized in that a foil is used which comprises a parting agent between the support foil and the vapour deposited metal layer.

17. Method according to claim 15, characterized in that a foil is used in which the vapor deposited metal layer is additionally covered with a bonding plastic layer.

18. Method according to claim 17 in which the bonding plastic layer consists of ethylene-vinyl acetate copolymer.

19. Method according to claim 9, characterized in that the metal-coated foil is pressed together with the plastic-coated support under a pressure of about $4 \cdot 10^5$ to about $6 \cdot 10^5$ Pa and at a temperature of about 110°–140° C.

20. A reflecting flexible textile web comprising a textile support having metal coated on at least one side thereof, said textile support being chosen from the class consisting of a textured woven fabric and a textured mesh fabric, whose threads are coated with flame-retarding modified transparent acrylate copolymers containing ethylene-vinyl acetate copolymer, with said metal coating being disposed substantially only in the region of the intersections of the threads of the textile support while the regions of the textile support disposed between the intersections are substantially free from the metal coating and thus permeable to light, said web having a diffuse reflection of 60–90% of the light and thermal radiation, incident on the metal-coated side, of the near infrared range with wavelengths between 0.7 and 2.5 μm.

* * * * *